United States Patent [19]

Hinzpeter et al.

[11] Patent Number: 4,988,275

[45] Date of Patent: Jan. 29, 1991

[54] ROTARY PELLETIZING MACHINE

[75] Inventors: Juergen Hinzpeter; Christian Medicus; Siegfried Franke, all of Schwarzenbek, Fed. Rep. of Germany

[73] Assignee: Firma Wilhelm Fette GmbH, Schwarzenbek, Fed. Rep. of Germany

[21] Appl. No.: 187,079

[22] Filed: Apr. 27, 1988

[30] Foreign Application Priority Data

Apr. 27, 1987 [DE] Fed. Rep. of Germany ..... 3714031

[51] Int. Cl.[5] ..... B30B 11/08

[52] U.S. Cl. ..... 425/186; 425/193; 425/344; 425/345; 425/353

[58] Field of Search ..... 425/182, 185, 186, 193, 425/344, 345, 352-355

[56] References Cited

U.S. PATENT DOCUMENTS

| | | | |
|---|---|---|---|
| 3,332,367 | 7/1967 | Sperry et al. | 425/345 |
| 3,518,950 | 7/1970 | Crossley | 425/345 |
| 3,566,806 | 3/1971 | Forster | 425/345 |
| 3,891,375 | 6/1975 | Pilewski et al. | 425/354 |
| 3,912,441 | 10/1975 | Shimada et al. | 425/261 |
| 3,924,996 | 12/1975 | Talis et al. | 425/355 |
| 3,999,922 | 12/1976 | Shimada | 425/345 |
| 4,057,381 | 11/1977 | Korsch | 425/352 |
| 4,362,491 | 12/1982 | Livingstone | 425/186 |

FOREIGN PATENT DOCUMENTS

| | | | |
|---|---|---|---|
| 246323 | 11/1969 | U.S.S.R. | 425/345 |
| 530798 | 12/1976 | U.S.S.R. | 425/354 |

*Primary Examiner*—Jay H. Woo
*Assistant Examiner*—James P. Mackey
*Attorney, Agent, or Firm*—Michael J. Striker

[57] ABSTRACT

A rotary pelletizing machine includes a housing and a pelletizing assembly removably secured in the housing and including a rotatable matrix disc, upper and lower punches supported in the matrix disc for joint rotation therewith and axial displacement relative thereto, upper and lower cams for controlling positions of the upper and lower discs, and elements that enable rotation of the matrix disc relative to the cams. Upon releasing elements that secure the assembly in the housing, the pelletizing assembly can be lifted from a drive shaft that extends in the housing for imparting rotation to the matrix disc, as a unit.

12 Claims, 2 Drawing Sheets

ROTARY PELLETIZING MACHINE

BACKGROUND OF THE INVENTION

The present invention relates to a rotary pelletizing machine. More particularly, it relates to a rotary pelletizing machine which has a matrix disc driven by a drive shaft and rotatably supported in a housing, with upper and lower punches which are guided in the matrix disc and controlled during rotation of the matrix disc by stationary cams provided with holders.

Rotary pelletizing machines of the above-mentioned general type are known in the art. For an effective utilization of pelletizing presses, it is necessary to design them so that the time which is required both for a re-equipping of a machine for subsequent production of pellets of a different type, as well as for cleaning of individual machine parts for conversion to a different pelletizing material be maintained as short as possible in relationship to the time of the operation of the pelletizing press or the production time. It has been considered as advantageous to produce pellets of a predetermined type over a long time for example 5 days and then to clean the machine over several hours without performing any production, for a subsequent processing of the different pelletizing material or to re-equip the machine for a subsequent production of bigger or smaller pellets with a different pressure.

Increasing output capacity of pelletizing presses, the requirement of short storage of press material, as well as increased requirement as to the cleanness of pellets by medical legislative authorities lead generally to constantly reducing batch sizes, or in other words, time within which pellets of one type are produced.

For reducing the time which is required for re-equipping of the machine, for example with another punch spacing or another punch print, and for cleaning of individual parts for an exchange of pelletizing material to be pressed, many considerations must be taken care of for a partial exchange of the machine. A known solution in this aspect is that the rotor or the matrix disc is exchangeable in a relatively simple manner. An exchange of the matrix disc is, however, possible in accordance with this solution only after a preceding dismounting of individual punches and their cam guides. A significant time saving which is required for effective production time is not obtained with this solution.

SUMMARY OF THE INVENTION

Accordingly, it is an object of the present invention to provide a rotary pelletizing machine which avoids the disadvantages of the prior art.

More particularly, it is an object of the present invention to provide a rotary pelletizing machine in which the ratio between the production time and the stoppage time for its re-equipping and cleaning is considerably improved.

In keeping with these objects and with others which will become apparent hereinafter, one feature of the present invention resides, briefly stated, in that in a rotary pelletizing machine having a rotatable matrix disc with upper and lower punches, upper and lower cams as well as cam holders, the holders of the cams are connected with the matrix disc and at the same time are connected by releasable connecting means with stationary machine parts or housing parts, so that the connecting means can be released and after their release the matrix disc together with the upper and lower punches and the cams can be removed from a drive shaft of the matrix disc.

When the rotary pelletizing machine is designed in accordance with the present invention, the matrix disc or rotor with the punches and cams be disassembled outside of the machine for cleaning or re-equipping, while another similar or identical structural unit which has been cleaned before the removal of the first structural unit and which is suitable for a new production, can be immediately used in the machine. In other words, a great part of the required cleaning and re-equipping works is performed simultaneously with the production, so that the re-equipment time and the time of cleaning coincides with the manufacturing time.

When the rotary pelletizing machine is designed and the method is performed in accordance with the present invention, the time of stoppage of the press during re-equipment is considerably reduced and the flexibility of the use of the machine by the utilization of matrix discs with different spacing is additionally increased.

Connecting means for the rotatable matrix disc, the stationary cams, the drive shaft and the remaining parts of the machine or in other words of the housing can be formed as simple screws. Only a few screws must be released and again tightened for exchanging the whole structural unit. Instead of the screws, also clamping connections or arresting elements of a known type can be used, so that the exchange or release and withdrawal of a structural unit composed substantially of the matrix disc, the punches and the cams can be performed completely automatically at respective occasion. Such an automatic mounting and releasing of the structural unit can be performed by linear drives and clamping shoes.

For removal and transportation of the structural unit, the pelletizing machine is provided with a supporting arm which engages the structural unit after the release of the connecting means, lifts it from the machine and displaces for allowing the placing of another structural unit.

The holders of the cams can be connected with the matrix disc by entraining members which are formed as pins engageable with annular grooves of the matrix disc. The cams in turn can be connected with the holder by screws. The cam holders can carry supports for the punches, arranged between pressing rollers which cooperate with the punches. Finally, the upper pressing roller can be height-adjustable.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
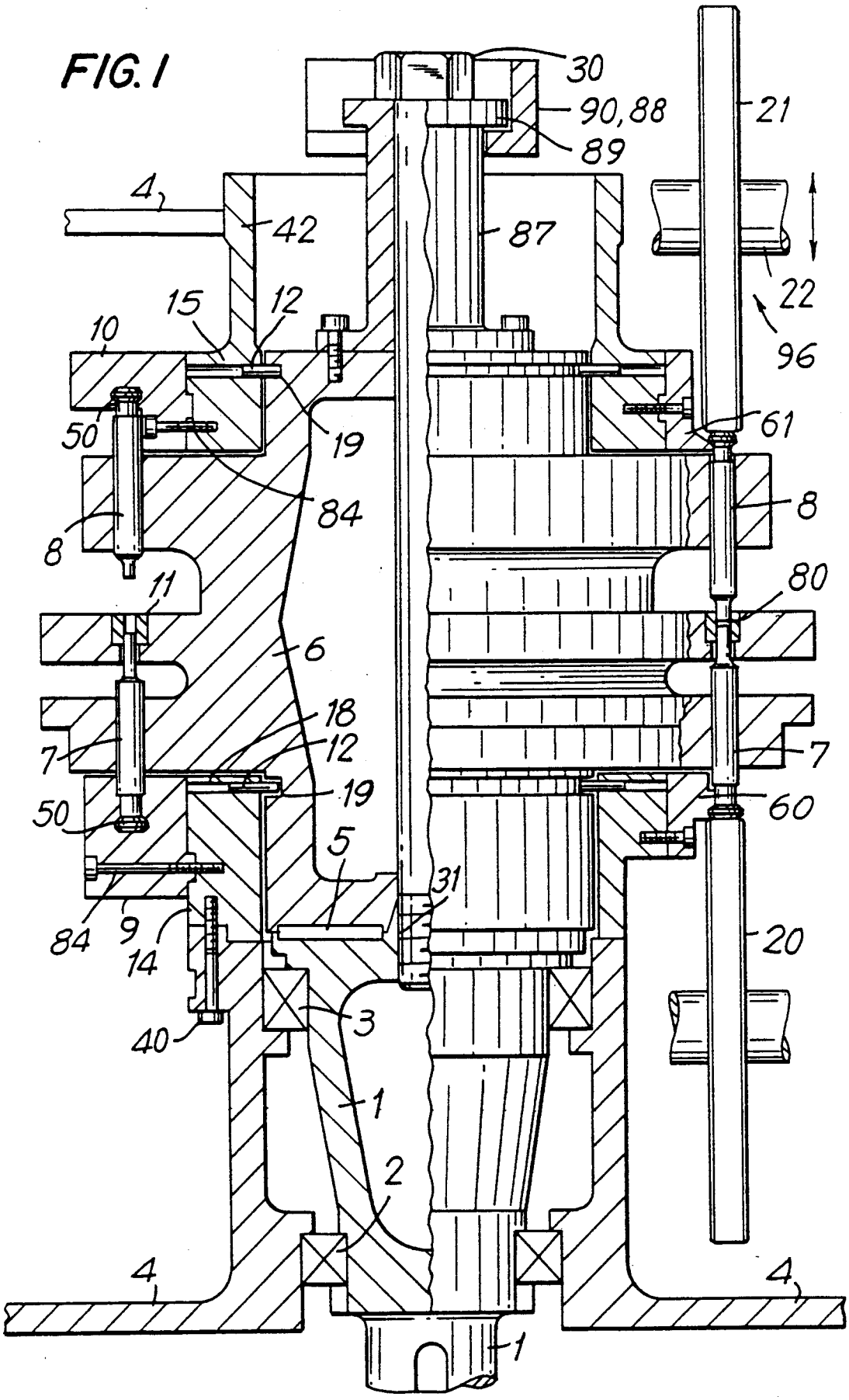
FIG. 1 is a view showing a vertical section of the rotary pelletizing machine in accordance with the present invention.

A rotary pelletizing machine in accordance with the present invention has a rotatably supported matrix disc 6 which is provided with a plurality of matrixes 11. The matrixes 11 are uniformly distributed over the periphery of the matrix disc 6. The compression of pelletizing material for producing pellets is performed in the matrixes by a lower punch 7 and an upper punch 8. The upper and lower punches 7 and 8 are held displaceably in associated openings of the matrix disc 6. The positioning of the lower punches 7 is performed by a rail-like control cam 9 having control slots 50 while the positioning of the upper punch 8 is performed by a control cam 10 having a slot 50.

The matrix disc 6 is supported in a stationary housing 4. A drive shaft 1 is provided for driving the matrix disc 6 and rotatably supported in the housing 4 through bearings 2 and 3. The drive shaft 1 is connected with the matrix disc 6 by an entraining element 5 which is formed as a key. For clamping the matrix disc 6 with the drive shaft 1, a clamping screw 30 is provided. It extends from above through the matrix disc 6 downwardly into the shaft 1 and is connected with the latter by a thread 31. The head of the screw 30 abuts against a clamping sleeve 87 which is screwed with the matrix disc 6.

When during the operation of the machine, the matrix disc 6 rotates and with it also the upper and lower punches 7 and 8 rotate about an axis of the drive shaft 1, the punches arrive at a pressing station 96 which is shown at right side of FIG. 1. Here they are displaced by a lower pressing roller 20 and an upper pressing roller 21 to a position in which an individual pellet is finally pressed inside a pressing chamber 80.

During rotation of the matrix dis and punches the cams 9 and 10 remain immovable in their position.

The cam 9 is connected for this purpose by a screw 84 with a cam holder 14 which in turn is connected by screws 40 with the housing 4 in a position - fixed and at the same time releasable manner. Similarly, the cam 10 for controlling the upper punch 8 is connected with a cam holder 15 by screws 84. This cam holder 15 is also connected with the stationary housing 4 by screws 40 which are not shown in FIG. 1 since they are located in a plane which extends as a cutting plane to the plane of the drawing. A cylindrical portion 42 of the holder 15 is connected releasably with the stationary housing by screws 40.

The holders 14 and 15 for the control cams 9 and 10 have openings 18. Pins 12 extend through the openings 18 and extend into annular grooves 19 of the matrix disc 6. With this arrangement the matrix disc 6 together with the lower punch 7 and the upper punch 8 and the cams 9 and 10 can be removed as a joint unit from the drive shaft 1 and replaced by a similar structural unit. For this purpose the clamping screw 30, the clamping screws 40 for the lower control cam 9, and the not shown clamping screws 40 for the upper control cam 10 must be released. Then the whole structural unit is lifted, for example by a supporting arm 90 which has a fork-shaped extension 88 engaging under a collar 89 of the clamping sleeve 87. In this way both the removal of the matrix disc 6 through the pin 12 acting as an entraining element, as well as a removal of the cams 9 and 10 and thereby the punches 7 and 8 is performed.

The lifting of the above discussed structural unit is also possible when in correspondence with FIG. 1 the upper punch 8 is located under the upper pressing roller 21, for which purpose a shaft 22 of this roller is arranged in a height-adjustable manner. Thereby first the pressing roller 21 is insignificantly lifted to enable the structural unit (the pelletizing assembly including the matrix disc 6, the punches 7 and 8, the cams 9 and 10, the holders 14 and 15, and all connecting elements) insignificantly lifted so that the structural unit can be turned laterally. During this lifting it is necessary to prevent falling of the punch which is located in the region of the pressing station 96 and not held by the cams 9 and 10, from the matrix disc. For this purpose, supports 60 and 61 are provided in this region for holding the heads of the lower punch 7 and upper punch 8.

Figure 2:
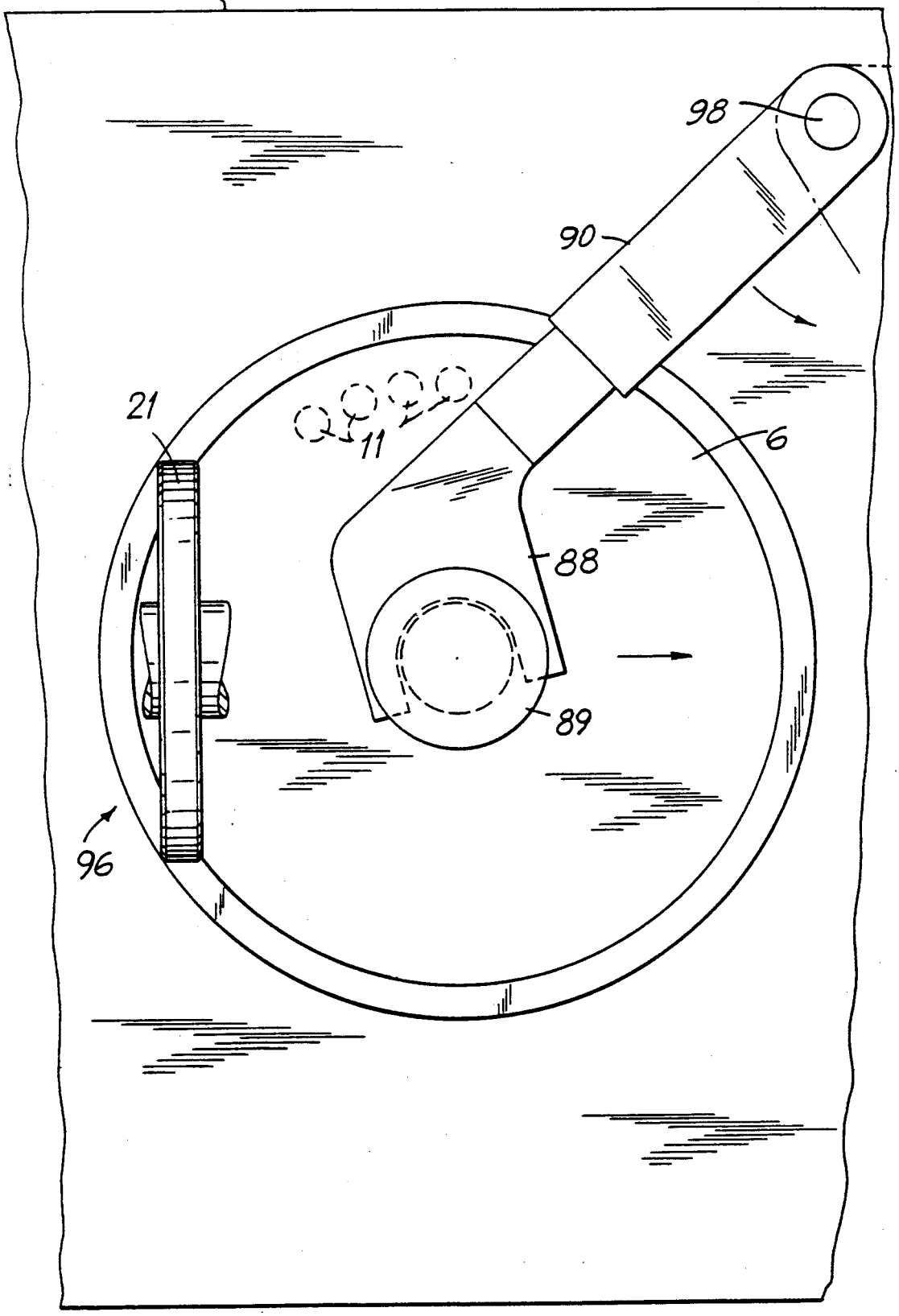
FIG. 2 is a plan view of the inventive rotary pelletizing machine with a supporting arm.

As can be seen from FIG. 2, the turnable supporting arm provided for transporting the complete structural unit is of a telescopic type for displacing the structural unit rectilinearly during turning about an axis 98. It is to be understood that instead of such a supporting arm it is also possible to use other constructions, such as for example rails or devices which operate automatically.

It will be understood that each of the elements described above, or two or more together, may also find a useful application in other types of constructions differing from the types described above.

While the invention has been illustrated and described as embodied in a rotary pelletizing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A rotary pelletizing machine, comprising a housing; a pelletizing assembly located in said housing and including a rotatable matrix disc, upper and lower punches supported in said matrix disc for joint rotation therewith and for axial displacement relative thereto, upper and lower cams for controlling positions of said upper and lower punches, respectively, and means for enabling rotation of said matrix disc relative to said upper and lower cams; a drive shaft extending in said housing for imparting rotation to said matrix disc; and means for removably securing said pelletizing assembly in said housing, said removably securing means being releasable to enable lifting of said pelletizing assembly from said drive shaft as a unit.

2. A rotary pelletizing machine as defined in claim 1, wherein said matrix disc rotation enabling means includes upper and lower holders, means for fixedly connecting said upper and lower holders with said upper and lower cams, respectively, and entraining members for rotatably connecting said matrix disc to said upper and lower holders, said removably securing means comprising means for releasably connecting said upper and lower holders with said housing.

3. A rotary pelletizing machine as defined in claim 2, wherein said matrix disc has a projection, said pelletizing machine further comprising means for lifting said pelletizing assembly from said drive shaft, said lifting means including a supporting arm engaging said projection.

4. A rotary pelletizing machine as defined in claim 2, wherein said means for releasably connecting said holders with said housing includes screws.

5. A rotary pelletizing machine as defined in claim 2, wherein said means for releasably connecting said holders with said housing includes clamping connections.

6. A rotary pelletizing machine as defined in claim 2, wherein said means for releasably connecting said holders with said housing includes arresting elements.

7. A rotary pelletizing machine as defined in claim 2, wherein said means for releasably connecting said holders with said housing includes automatically releasable connecting means.

8. A rotary pelletizing machine as defined in claim 2, wherein said matrix disc is provided with annular grooves, said entraining members includes pins engaging in said annular grooves of said matrix disc.

9. A rotary pelletizing machine as defined in claim 2, wherein said means for fixedly connecting said holders with said cams includes screws.

10. A rotary pelletizing machine as defined in claim 2; and further comprising supports provided for supporting said upper and lower punches and carried by said holders.

11. A rotary pelletizing machine as defined in claim 10; and further comprising pressing rollers cooperating with said upper and lower punches, said supports for said upper and lower punches being located between said pressing rollers.

12. A rotary pelletizing machine as defined in claim 11, wherein said pressing rollers include an upper roller and a lower roller; said upper roller being supported in a height-adjustable manner.

* * * * *